US010569560B2

(12) United States Patent
Wada et al.

(10) Patent No.: US 10,569,560 B2
(45) Date of Patent: Feb. 25, 2020

(54) INKJET PRINTING APPARATUS AND INK FILLING METHOD FOR THE SAME

(71) Applicant: CANON KABUSHIKI KAISHA, Tokyo (JP)

(72) Inventors: Naoaki Wada, Yokohama (JP); Toshiro Sugiyama, Yokohama (JP); Noriyuki Aoki, Tokyo (JP); Toshiaki Yamaguchi, Machida (JP); Masakazu Nagashima, Yokohama (JP); Ryohei Maruyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/937,702

(22) Filed: Mar. 27, 2018

(65) Prior Publication Data

US 2018/0281444 A1 Oct. 4, 2018

(30) Foreign Application Priority Data

Mar. 31, 2017 (JP) ..... 2017-072378

(51) Int. Cl.
*B41J 2/165* (2006.01)
*B41J 2/175* (2006.01)
(Continued)

(52) U.S. Cl.
CPC ..... *B41J 2/17596* (2013.01); *B41J 2/16508* (2013.01); *B41J 2/16517* (2013.01);
(Continued)

(58) Field of Classification Search
CPC ..... B41J 2/17596; B41J 2/16517; B41J 2/16523; B41J 2/16508; B41J 2/175;
(Continued)

(56) References Cited

U.S. PATENT DOCUMENTS

2004/0141023 A1* 7/2004 Nakamura ..... B41J 2/175 347/30
2004/0257410 A1* 12/2004 Yamada ..... B41J 2/175 347/84

(Continued)

FOREIGN PATENT DOCUMENTS

CN 1502474 A 6/2004
CN 1636746 A 7/2005
JP 2002-248792 A 9/2002

*Primary Examiner* — Scott A Richmond
(74) *Attorney, Agent, or Firm* — Canon U.S.A. Inc., IP Division

(57) ABSTRACT

An inkjet printing apparatus includes a print head, an ink tank containing ink to be supplied to the print head, a cap switchable between a covering position to cover a discharge port face and an exposing position to expose the discharge port face, a suction unit connected to the cap, and a control unit. The control unit controls the performing of an ink filling operation of filling the print head with the ink supplied from the ink tank. The ink filling operation includes a valve-closing suction operation of performing suction through the suction unit for a predetermined period of time while the cap is in the covering position. The apparatus further includes a detection unit configured to detect an ink filling state. The control unit controls the stopping of the ink filling operation in accordance with a detection result of the detection unit.

7 Claims, 15 Drawing Sheets

(51) Int. Cl.

| | |
|---|---|
| ***B41J 2/17*** | (2006.01) |
| ***B41J 29/38*** | (2006.01) |
| ***B41J 29/02*** | (2006.01) |
| *B41J 2/21* | (2006.01) |

(52) U.S. Cl.
CPC ..... *B41J 2/16523* (2013.01); *B41J 2/175* (2013.01); *B41J 2/1721* (2013.01); *B41J 2/1752* (2013.01); *B41J 2/17523* (2013.01); *B41J 29/02* (2013.01); *B41J 29/38* (2013.01); *B41J 2/17503* (2013.01); *B41J 2/2103* (2013.01); *B41J 2002/1728* (2013.01)

(58) Field of Classification Search
CPC .... B41J 2/1752; B41J 2/17523; B41J 2/1721; B41J 2/2103; B41J 2/17503; B41J 29/38; B41J 2002/1728; B41J 2002/1735; B41J 2002/1742; B41J 2002/1856; B41J 2/1652; B41J 2/16532
See application file for complete search history.

(56) References Cited

U.S. PATENT DOCUMENTS

| | | | | |
|---|---|---|---|---|
| 2005/0151800 | A1* | 7/2005 | Kono | B41J 2/175 347/85 |
| 2005/0151804 | A1* | 7/2005 | Hayashi | B41J 2/175 347/85 |
| 2008/0079790 | A1* | 4/2008 | Kachi | B41J 2/17509 347/87 |
| 2010/0327025 | A1* | 12/2010 | Yokoyama | B41J 2/175 347/89 |

* cited by examiner

INKJET PRINTING APPARATUS AND INK FILLING METHOD FOR THE SAME

BACKGROUND

Field of the Disclosure

The present disclosure generally relates to an inkjet printing apparatus including an ink tank, a print head, and a supply tube connecting the ink tank to the print head and an ink filling method for the same.

Description of the Related Art

Japanese Patent Laid-Open No. 2002-248792 discloses an inkjet printing apparatus including an ink tank, a print head, an ink supply tube connecting the ink tank to the print head, and an on-off valve disposed in the ink supply tube. The print head is filled with ink by a suction operation including depressurizing the ink supply tube and the print head through a suction unit while the on-off valve is closed and opening the on-off valve when a pressure in the ink supply tube and the print head reaches a predetermined value. The suction operation is performed a predetermined number of times to fill a passage extending from the ink tank to the print head and including the print head with the ink.

SUMMARY

The inkjet printing apparatus disclosed in Japanese Patent Laid-Open No. 2002-248792 has the following disadvantage. Although ink filling is completed by repeating the above-described suction operation the predetermined number of times, the suction operation may be performed to suck a larger amount of ink than is actually needed for ink filling.

Aspects of the present disclosure relate to an inkjet printing apparatus capable of reducing the amount of ink discharged when a print head is filled with ink supplied from an ink tank.

An aspect of the present disclosure provides an inkjet printing apparatus including a print head having a discharge port face in which a plurality of discharge ports that discharge ink are arranged, an ink tank containing the ink to be supplied to the print head, an on-off valve disposed in an ink passage between the print head and the ink tank and configured to be switchable between an open position and a closed position, a cap configured to be switchable between a covering position to cover the discharge port face and an exposing position to expose the discharge port face, a suction unit connected to the cap, a pressure measuring unit configured to measure a pressure at a predetermined position in the ink passage between the on-off valve and the suction unit, and a control unit. The control unit controls the performing of an ink filling operation of filling the print head with the ink supplied from the ink tank. The ink filling operation includes a valve-closing suction operation of performing suction through the suction unit for a predetermined period of time while the on-off valve is in the closed position and the cap is in the covering position and then switching the on-off valve to the open position. The control unit controls the stopping of the ink filling operation in accordance with a pressure variation per unit time measured by the pressure measuring unit.

Further features of the present disclosure will become apparent from the following description of exemplary embodiments with reference to the attached drawings.

DESCRIPTION OF THE EMBODIMENTS

Embodiments of an inkjet printing apparatus according to the present disclosure will be described. Constituent elements described in the embodiments are intended to be illustrative only and are not intended to limit the scope of the present disclosure. In the present specification, a serial inkjet printing apparatus will be described as an example. The serial inkjet printing apparatus performs printing by reciprocating a head that discharges ink to a printing medium, which is intermittently conveyed, in a direction intersecting a conveying direction in which the printing medium is conveyed. However, the present disclosure is applicable not only to the serial inkjet printing apparatus but also to a line inkjet printing apparatus that performs continuous printing using a long print head. The term "ink" as used herein is used as a general term for liquid, such as recording liquid. The term "print or printing" as used herein includes not only printing on a two-dimensional object but also printing on a three-dimensional object. The term "printing medium" as used herein refers to an object to which liquid is discharged, and is used as a general term for printing media including, but not limited to, paper, cloth, a plastic film, a metal plate, glass, ceramic, wood, and leather. Examples of the inkjet printing apparatus include a personal computer (PC) printer and a multifunction printer having, for example, a copy function and a facsimile function.

First Embodiment

Figure 1:
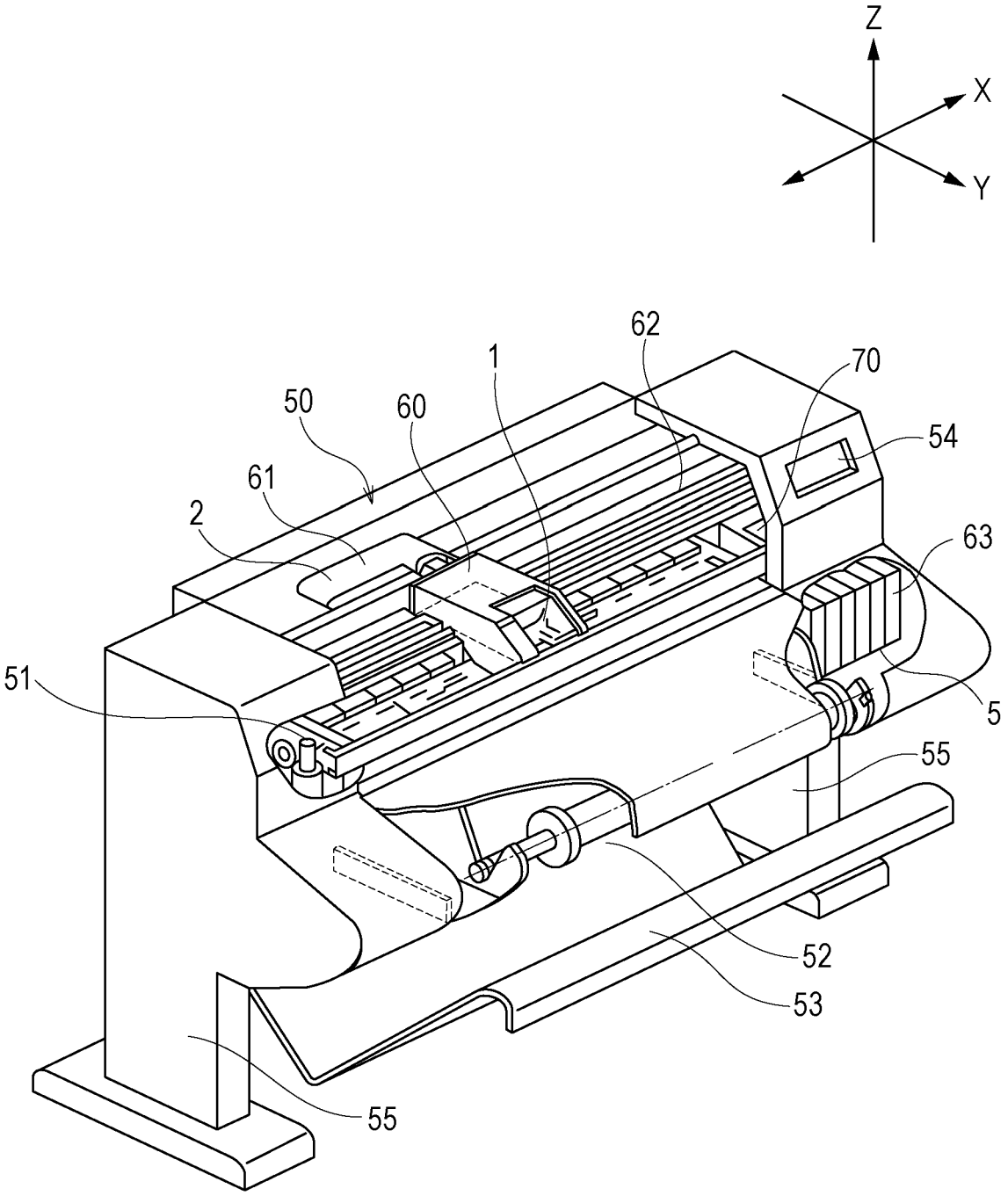
FIG. 1 is a perspective view illustrating an inkjet printing apparatus according to a first embodiment.

FIG. 1 is a perspective view illustrating an inkjet printing apparatus (hereinafter, referred to as a "printing apparatus") 50. The printing apparatus 50 is fixed to and supported by upper ends of two legs 55 facing each other. A print head 1 that performs a printing operation of discharging ink to a printing medium to print an image is mounted on a carriage 60, which is reciprocated in an X direction by a belt transfer mechanism 62. The print head 1 discharges ink droplets from discharge ports in accordance with print data transmitted from, for example, a host computer.

The printing apparatus 50 includes a roll holder unit 52 for holding a printing medium such that the roll holder unit 52 is located in the front of the apparatus. The printing medium in the first embodiment is a roll of continuous sheet. The printing medium is fed from the roll holder unit 52 into the printing apparatus 50 to a printing position, at which the print head 1 performs the printing operation. The printing medium with a printed image is conveyed in a Y direction intersecting the X direction. In the present embodiment, the X direction is orthogonal to the Y direction. Upon printing of an image of one band in the printing operation of the print head 1, the printing medium is conveyed in the Y direction by a predetermined amount of conveyance by rotating a conveying roller 51 (intermittent conveying operation). The printing operation corresponding to one band and the intermittent conveying operation are repeated, thereby printing images on the printing medium. At completion of printing on the printing medium, the printing medium is cut by a cutter (not illustrated). The cut printing medium is placed onto a stacker 53 disposed in the front of the printing apparatus 50.

The printing apparatus 50 further includes an ink supply unit 63 located in the front of the apparatus. The ink supply unit 63 includes ink tanks 5 respectively containing different color inks, such as a black ink, a cyan ink (first ink), a magenta ink (second ink), and a yellow ink. Each ink tank 5 is removable from the printing apparatus 50. The ink tank 5 is connected to a supply tube (ink supply path) 2 formed of, for example, a flexible member. The supply tube 2 connects the ink tank 5 and the print head 1. The print head 1 has a discharge port face 20 in which a plurality of discharge ports are arranged. The discharge port face 20 faces the printing medium. The discharge port face 20 has a discharge port array for each color. The discharge port array includes a plurality of discharge ports arranged in the Y direction. The supply tubes 2 arranged for the different color inks are connected to the respective discharge port arrays and are bundled together by a tube guide 61.

A recovery unit 70 is disposed within a scanning range of the carriage 60 in the X direction and is located outside a conveyance area for the printing medium. The recovery unit 70 performs a cleaning operation by sucking ink or air from the discharge ports arranged in the discharge port face 20 as necessary and further performs a valve-closing suction operation, which will be described later, to fill the print head 1 with the inks supplied from the ink tanks 5.

The printing apparatus 50 includes an operation panel 54 located above the ink supply unit 63 in the front of the apparatus. A user operates the operation panel 54 to input an instruction to the printing apparatus 50. The operation panel 54 may be of a touch panel type having a display panel function of issuing a warning to the user, for example, when any of the ink tanks 5 has to be replaced.

Figure 2:
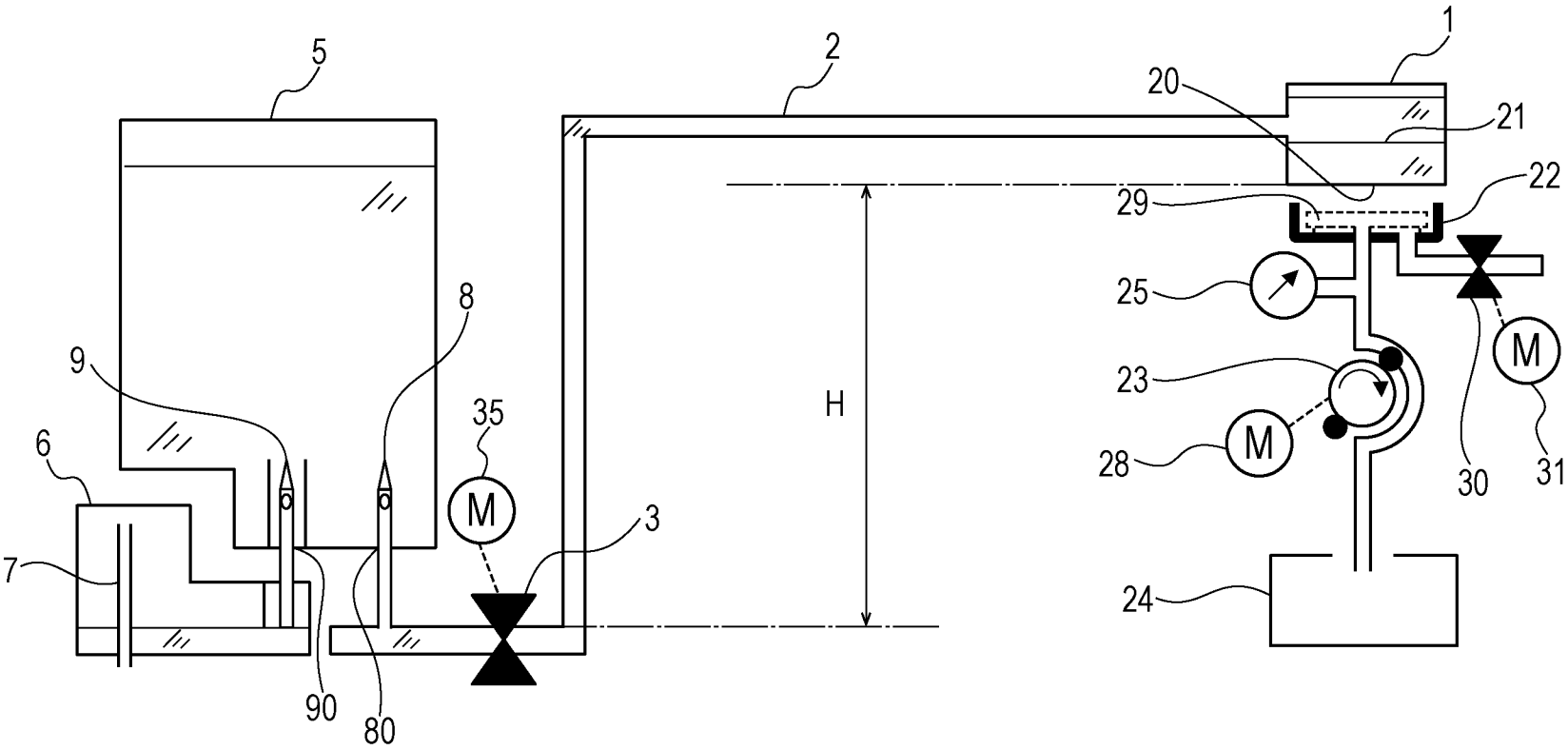
FIG. 2 is a schematic diagram illustrating an ink passage for one color ink in the inkjet printing apparatus according to the first embodiment.

FIG. 2 is a schematic diagram illustrating an ink passage for one color ink in the printing apparatus 50. An atmosphere communication chamber 6 is disposed vertically below the ink tank 5. The atmosphere communication chamber 6 includes a first hollow tube 9 extending vertically upward. The ink tank 5 includes a first joint 90 and a second joint 80 arranged in its bottom. The first joint 90 receives the first hollow tube 9, thus connecting the ink tank 5 to the atmosphere communication chamber 6. The atmosphere communication chamber 6 includes an atmosphere communication path 7 that communicates with the outside, or atmosphere. The ink tank 5 therefore communicates with the atmosphere through the atmosphere communication path 7.

The second joint 80 of the ink tank 5 receives a second hollow tube 8 connected to the supply tube 2 and extending vertically upward, thus connecting the ink tank 5 to the print head 1 through the supply tube 2. In the supply tube 2, an on-off valve 3 is disposed. The on-off valve 3 is switchable between an open position to open the supply tube 2 and a closed position to close the tube. The on-off valve 3 is driven by an on-off valve motor 35, serving as a driving source. In the following description, the inside of the print head 1 and the supply tube 2 will also be referred together to as an "ink supply path".

The print head 1 has the discharge port face 20, in which the discharge ports are arranged, in its bottom and includes a filter 21 for capturing impurities contained in the ink. The discharge port face 20 is disposed at a higher level in a vertical direction than a lower end of the first hollow tube 9 communicating with the atmosphere. Consequently, when the supply tube 2 connecting the ink tank 5 to the print head 1 and the print head 1 are filled with the ink, a negative pressure is held in each discharge port, thus maintaining a meniscus. In the printing operation, when the ink in the print head 1 is reduced by discharging the ink from each discharge port, the ink is supplied from the ink tank 5 to the discharge port through the supply tube 2 at any time. Such a method of ink supply is also called a water head difference system. In the present embodiment, the difference in level between the discharge port face 20 and the lower end of the first hollow tube 9, or water head difference H is approximately 80 mm.

An exemplary configuration of the recovery unit 70 will now be described. The recovery unit 70 includes a cap 22 capable of hermetically covering the discharge port face 20 and a suction pump (suction unit) 23 connected to the cap 22. The cap 22 is switchable between a covering position to hermetically cover the discharge port face 20 and an exposing position to expose the discharge port face 20. The cap 22 includes an absorber 29 located inside the cap. The suction pump 23 creates a negative pressure within the cap 22 via the absorber 29. The absorber 29 enables the inside of the cap 22 to be uniformly depressurized during suction through the suction pump 23. The suction pump 23 is a tube pump. An average flow rate is proportional to a rotation speed of the tube pump. In the present embodiment, a suction pump motor 28 regulates the suction pump 23 so that the flow rate is substantially constant.

In proximity of the cap 22, an air release valve 30 is disposed. The air release valve 30 switches between a communication state between the cap 22 and the atmosphere and a non-communication state therebetween. The air release valve 30 is opened or closed by an air release valve motor 31. In the present embodiment, a pressure sensor (pressure measuring unit) 25 is disposed between the cap 22 and the suction pump 23. The pressure sensor 25 converts the pressure of gas or liquid into an electrical signal and outputs the signal. Examples of the pressure sensor include a strain gauge pressure sensor that measures strain and a capacitance pressure sensor that measures a change in capacitance. Ink supply using the pressure sensor 25 will be described later.

For example, to perform a preliminary ink discharge operation (or preliminary discharge operation) for reducing or eliminating a discharge failure in the print head 1 as a recovery operation for the print head 1, ink is discharged to the absorber 29. The ink received by the cap 22 in such a recovery operation is sucked by the suction pump 23 and is then stored in a maintenance cartridge 24. A central processing unit (CPU) 11, which will be described later, calculates the amount of ink collected in the maintenance cartridge 24. When the calculated ink amount reaches a threshold, the user is notified that the maintenance cartridge 24 has to be replaced with a new one. The CPU 11 estimates the amount of ink flowed into the maintenance cartridge 24 and sequentially adds the estimated amounts in a capacity memory 26, thus calculating the amount of ink collected in the maintenance cartridge 24.

Figure 3:
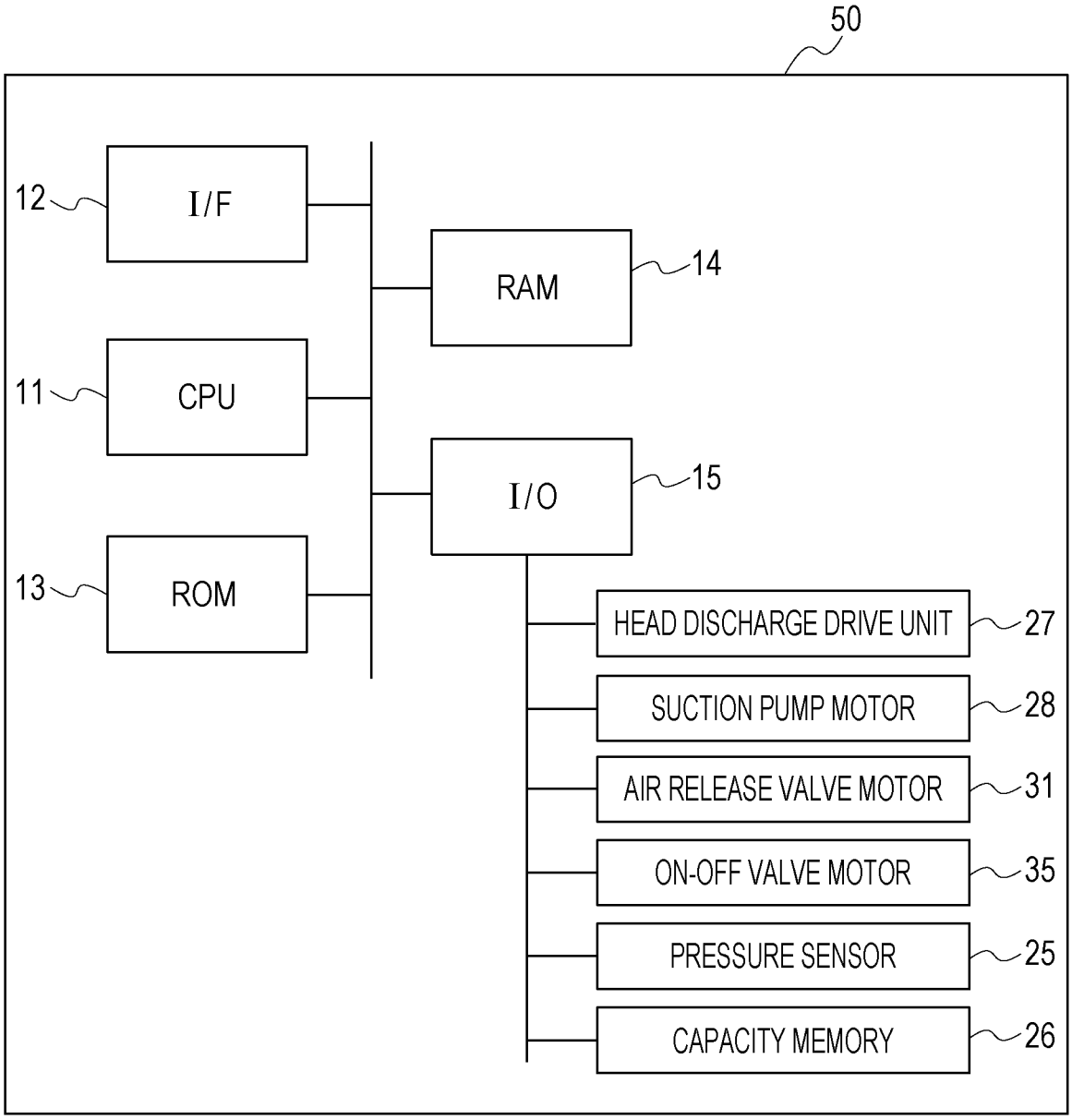
FIG. 3 is a block diagram illustrating an internal configuration of the inkjet printing apparatus according to the first embodiment.

FIG. 3 is a block diagram illustrating an internal configuration of the printing apparatus 50. The CPU 11 is a processor that controls the entire printing apparatus 50. A random access memory (RAM) 14 is a storage unit capable of holding information to be temporarily used when control software is run. A read-only memory (ROM) 13 is a storage unit that stores the control software and only permits information to be read. A user interface (I/F) 12 includes the operation panel 54 displaying information and keys to be operated by the user, and operates as a communication port for data transmission and reception to connect the printing apparatus 50 and the host computer. An input and output (I/O) unit 15 controls data input and output to/from a head discharge drive unit 27 that causes the print head 1 to discharge ink, the suction pump motor 28, the air release valve motor 31, the on-off valve motor 35, the pressure sensor 25, and the capacity memory 26.

The term "ink filling operation" as used herein refers to an operation of filling each supply tube 2 connecting the ink tank 5 to the print head 1 and the print head 1 with the ink upon initial installation of the printing apparatus 50. To perform the ink filling operation in the present embodiment, the valve-closing suction operation is repeatedly performed. The valve-closing suction operation will be described with reference to a flowchart of FIG. 4.

In step S401, the CPU 11 switches the cap 22 to the covering position to hermetically cover the discharge port face 20, and switches the on-off valve 3 to the closed position. In step S402, the CPU 11 drives the suction pump 23 to evacuate the print head 1 and the supply tube 2 through the cap 22. This removes the ink and air from the print head 1 and the supply tube 2, thus depressurizing the print head 1 and the supply tube 2.

Figure 4:
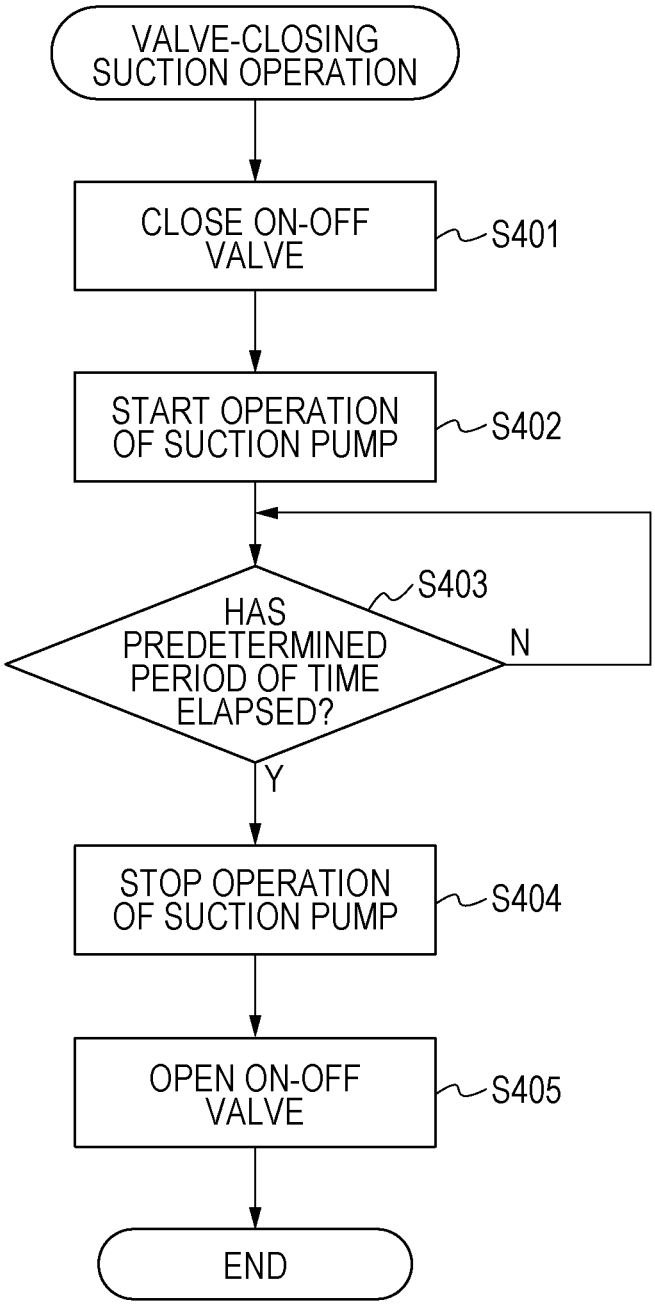
FIG. 4 is a flowchart illustrating a valve-closing suction operation of the inkjet printing apparatus according to the first embodiment.

In step S403, the CPU 11 determines whether a predetermined period of time (55 seconds in the present embodiment) has elapsed from the start of the operation of the suction pump 23. If suction has been performed for the predetermined period of time, the CPU 11 stops the operation of the suction pump 23 in step S404. In step S405, the CPU 11 switches the on-off valve 3 to the open position. Consequently, the ink is supplied from the ink tank 5 to the supply tube 2 and the print head 1, which have been under a negative pressure, in approximately one to two seconds. Such a process illustrated in FIG. 4 is referred to as a valve-closing suction operation.

The amount of ink that can be supplied per valve-closing suction operation is limited. Therefore, when the supply tube 2 having a large inner volume is used as in the present embodiment, the valve-closing suction operation has to be repeatedly performed. After the ink supply path including the print head 1 is filled with the ink, the air release valve 30 is opened and an idle suction operation using the suction pump 23 is performed to discharge the ink received in the absorber 29.

The valve-closing suction operation is performed regularly as well as upon initial installation. Specifically, when bubbles generated from the discharge ports are accumulated in the print head 1 and cause a discharge failure, the valve-closing suction operation is performed to force the bubbles to be discharged from the discharge ports. Furthermore, after the ink is discharged from the ink supply path for secondary transport in which the printing apparatus 50 used is moved to another place, the valve-closing suction operation is performed to refill the ink supply path with the ink.

Figure 5A:
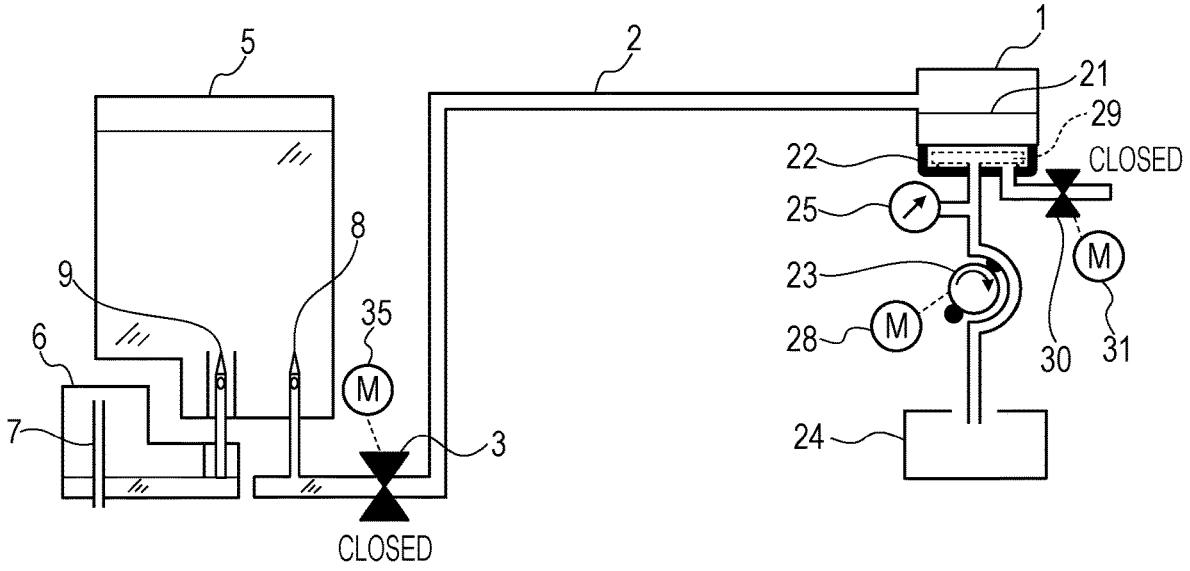
FIGS. 5A and 5B illustrate the first valve-closing suction operation upon initial installation of the inkjet printing apparatus according to the first embodiment.
Figure 5B:
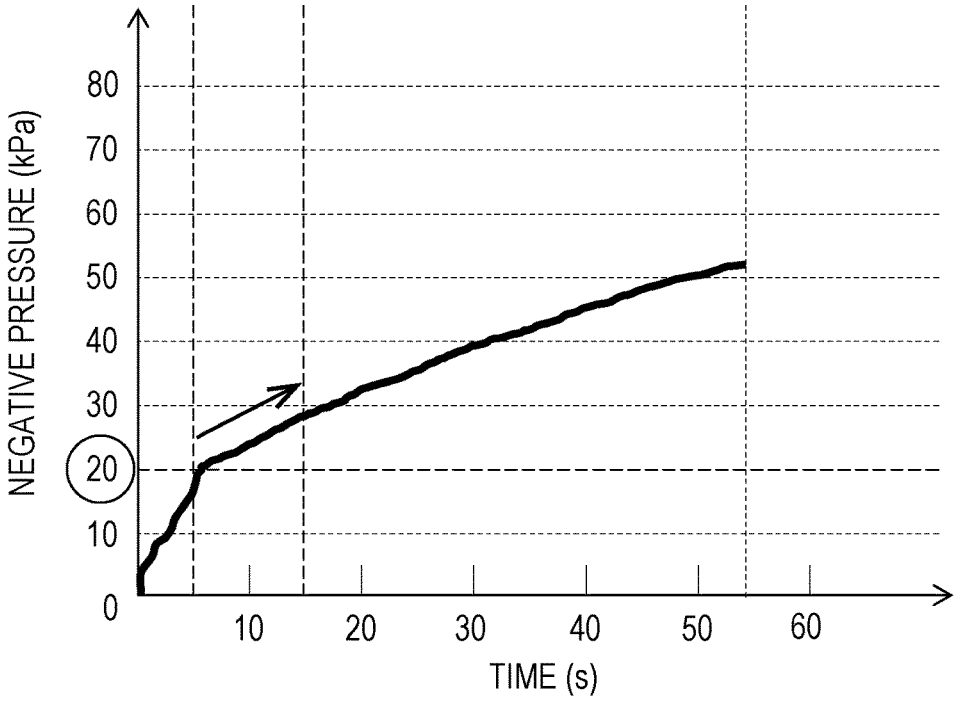

FIG. 5A illustrates a state in which the on-off valve 3 is in the closed position and the print head 1 and the supply tube 2 are depressurized for the first valve-closing suction operation upon initial installation of the printing apparatus 50. In other words, FIG. 5A corresponds to step S402 in the flowchart of FIG. 4. Since the printing apparatus 50 is installed for the first time, the supply tube 2 and the print head 1 are not supplied with the ink. FIG. 5B illustrates a change in pressure plotted against driven time of the suction pump 23. In FIG. 5B, the horizontal axis denotes time (s) and the vertical axis denotes a negative pressure (kPa). FIG. 5B demonstrates that the negative pressure rises as the suction pump 23 is operated.

Figure 6A:
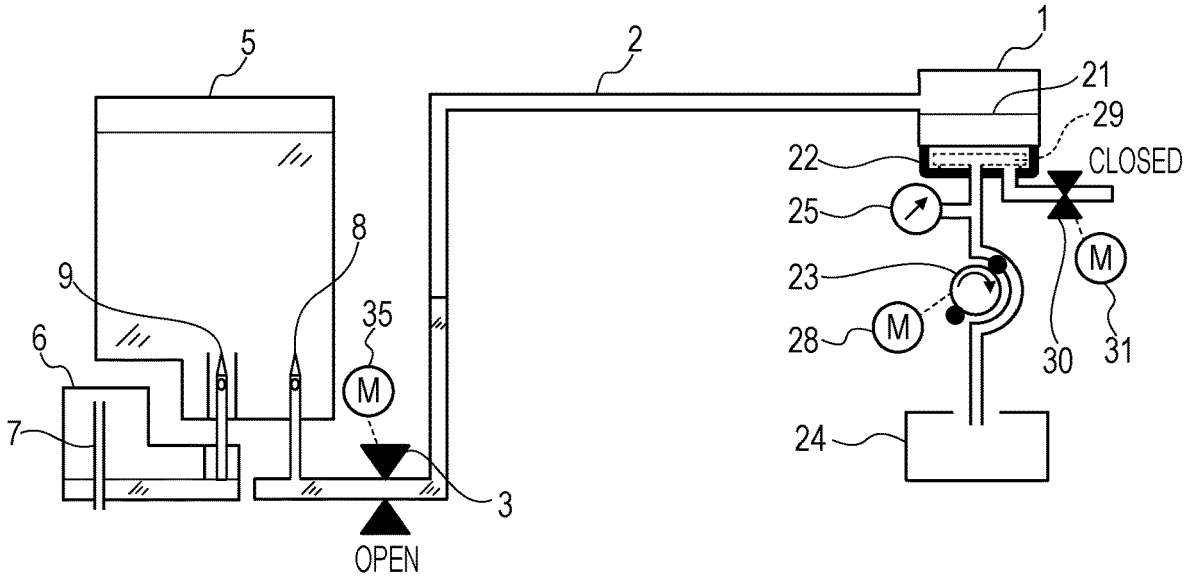
FIGS. 6A and 6B illustrate a state in which an on-off valve is opened in the valve-closing suction operation of the inkjet printing apparatus according to the first embodiment.
Figure 6B:
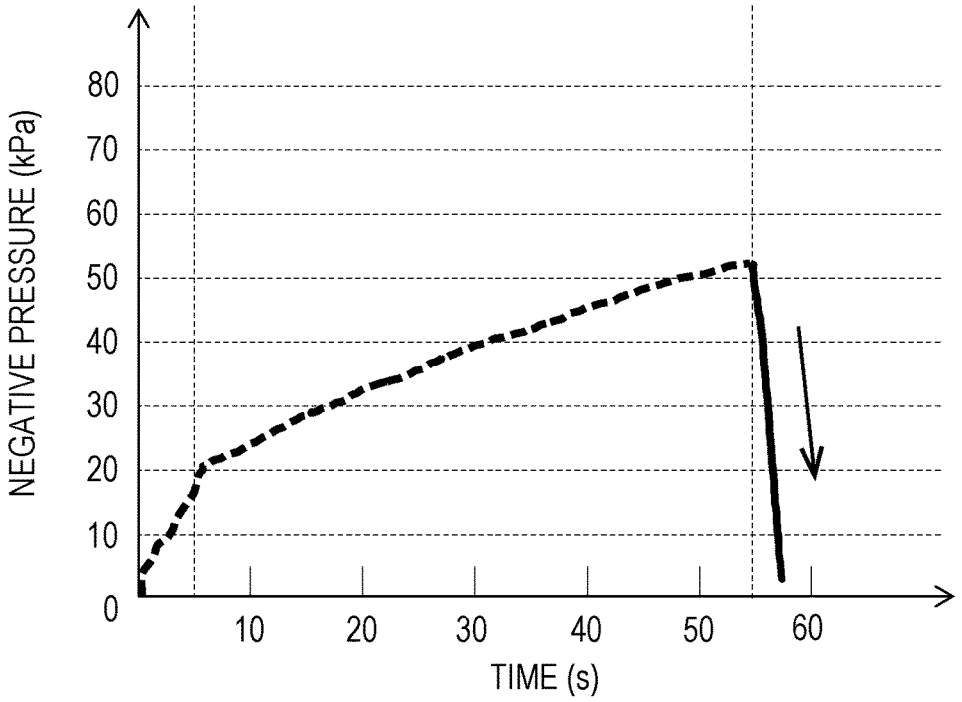

FIG. 6A illustrates a state in which the on-off valve 3 is in the open position after the suction operation through the suction pump 23 performed for the predetermined period of time. FIG. 6A corresponds to step S405 in the flowchart of FIG. 4. The supply tube 2 is partially filled with the ink by one valve-closing suction operation. FIG. 6B illustrates measured pressures in FIG. 6A. After a lapse of approximately 55 seconds, the on-off valve 3 is switched to the open position to release the pressure, resulting in a reduction in negative pressure. The above-described ink supply and the above-described change in pressure are caused by one valve-closing suction operation.

Filling the print head 1 with the ink by repeating the valve-closing suction operation will now be described with reference to FIGS. 5A, 5B, and 7A to 9B. As described above, FIG. 5A illustrates the state in which the on-off valve 3 is in the closed position and the print head 1 and the supply tube 2 are depressurized in the first valve-closing suction operation. FIG. 5B illustrates the measured pressures in this state. Since the print head 1 and the supply tube 2 are not supplied with the ink in the first valve-closing suction operation, the ink supply path is filled with air. The air has greater compressibility than liquid and tends to expand or contract depending on a change in pressure. Therefore, a pressure variation per unit time (gradient of the graph of FIG. 5B) is small in the state in which the ink supply path is filled with the air as illustrated in FIG. 5A.

In the present embodiment, the supply tube 2 has an inner volume of approximately 40 ml, the print head 1 has an inner volume of approximately 5 ml, and the ink passage between the cap 22 and the suction pump 23 has an inner volume of approximately 5 ml. In FIG. 5B, a pressure variation for a period of time from time=0 seconds to time=5 seconds after the start of suction through the suction pump 23 differs from that for the subsequent period of time. The reason is that a negative pressure up to approximately 20 kPa is influenced by liquid resistance in the discharge ports and the filter 21 of the print head 1. In other words, substantially the same pressure variation is measured for five seconds until the negative pressure reaches approximately 20 kPa, regardless of the amount of air in the print head 1 and the supply tube 2.

Pressure variations for the subsequent period of time are approximately 9 kPa for 10 seconds from time=5 seconds to time=15 seconds after the start of suction, approximately 8 kPa for 10 seconds from time=15 seconds to time=25 seconds, and approximately 6 kPa for 10 seconds from time=25 seconds to time=35 seconds. Upon initial installation, the ink passage including the supply tube 2, the print head 1, the cap 22, and the suction pump 23 and having a total inner volume of approximately 50 ml is filled with the air. Therefore, the suction pump 23 has a flow rate of approximately 0.5 ml/s, which is calculated based on the pressure variation per unit time illustrated in FIG. 5B and the relationship of PV=constant.

Figure 7A:
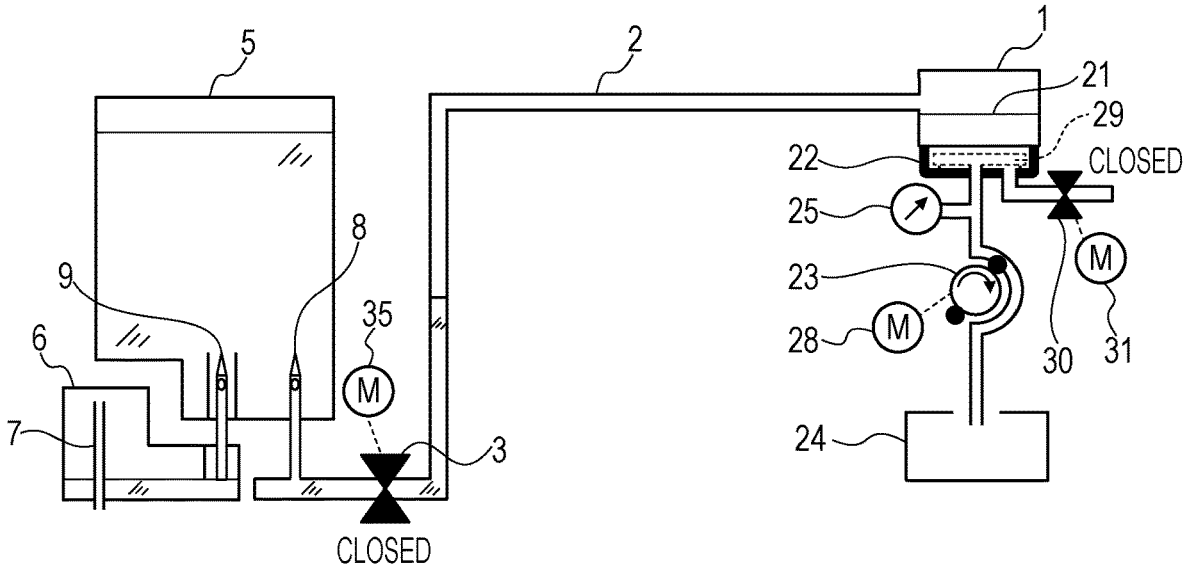
FIGS. 7A and 7B illustrate the second valve-closing suction operation upon initial installation of the inkjet printing apparatus according to the first embodiment.
Figure 7B:
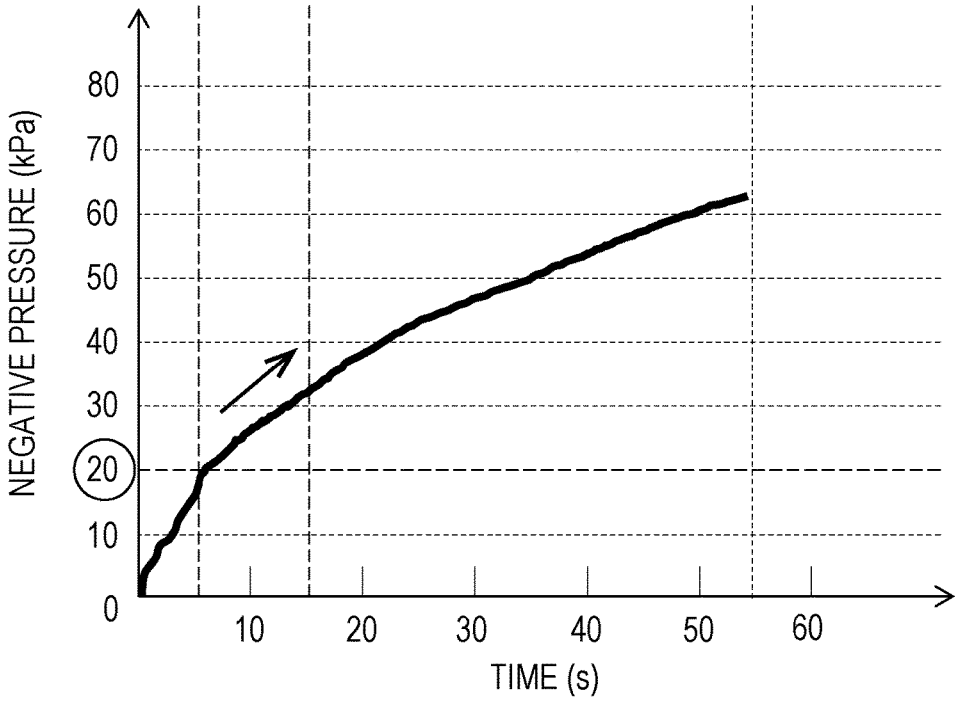

FIG. 7A illustrates a state in which the on-off valve 3 is in the closed position and the print head 1 and the supply tube 2 are depressurized in the second valve-closing suction operation. FIG. 7B illustrates measured pressures in this state. Since the supply tube 2 has been partially filled with the ink by the first valve-closing suction operation, the amount of air in the ink supply path is less than that in the first valve-closing suction operation. Therefore, a pressure variation per unit time illustrated in FIG. 7B is greater than that in the first valve-closing suction operation. The reason is as follows. Since liquid, such as water or ink, has less compressibility than the air and hardly expands or contracts, a pressure variation due to depressurization by the suction pump 23 increases as the amount of air is smaller and the amount of liquid is larger in the ink supply path.

Figure 8A:
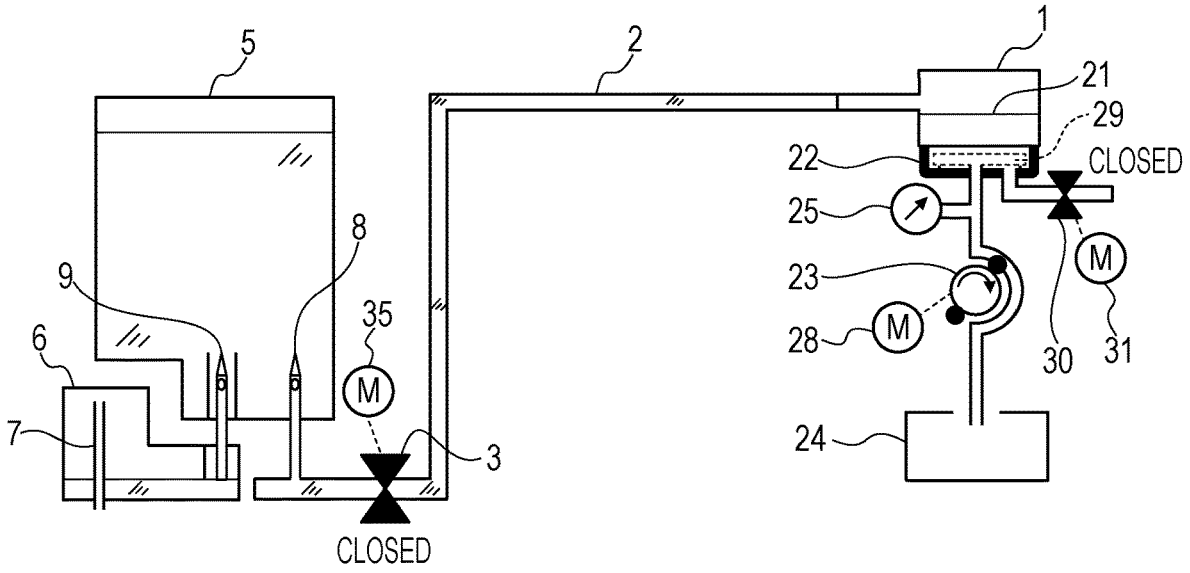
FIGS. 8A and 8B illustrate the third valve-closing suction operation upon initial installation of the inkjet printing apparatus according to the first embodiment.
Figure 8B:
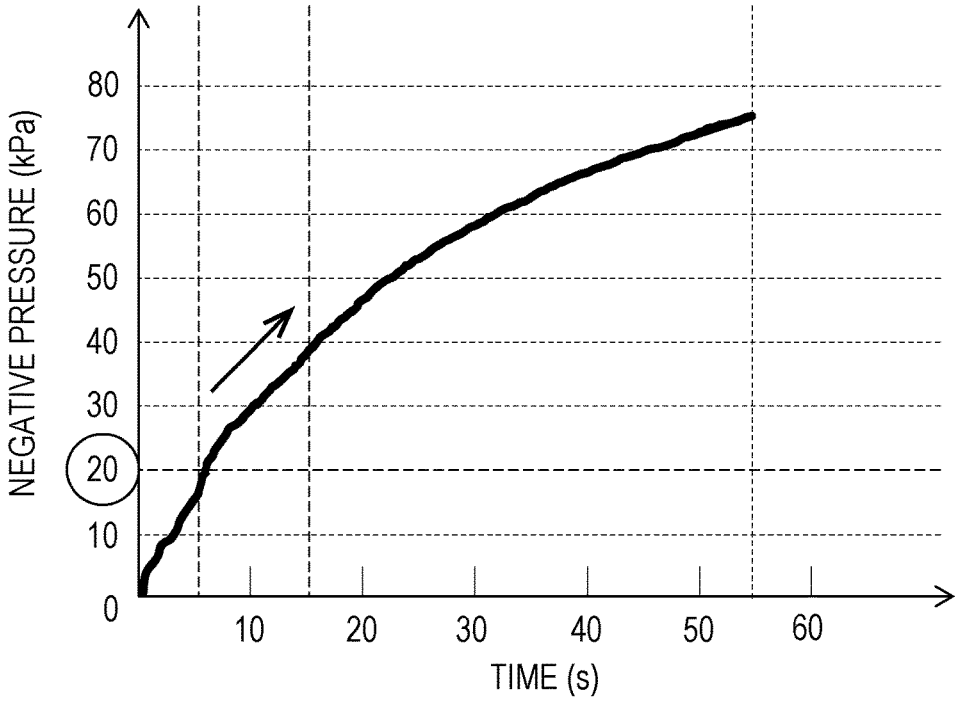

FIG. 8A illustrates a state in which the on-off valve 3 is in the closed position and the print head 1 and the supply tube 2 are depressurized in the third valve-closing suction operation. FIG. 8B illustrates measured pressures in this state. As illustrated in FIG. 8A, the supply tube 2 is partially filled with the ink by two valve-closing suction operations such that the ink is in proximity to the print head 1.

Figure 9A:
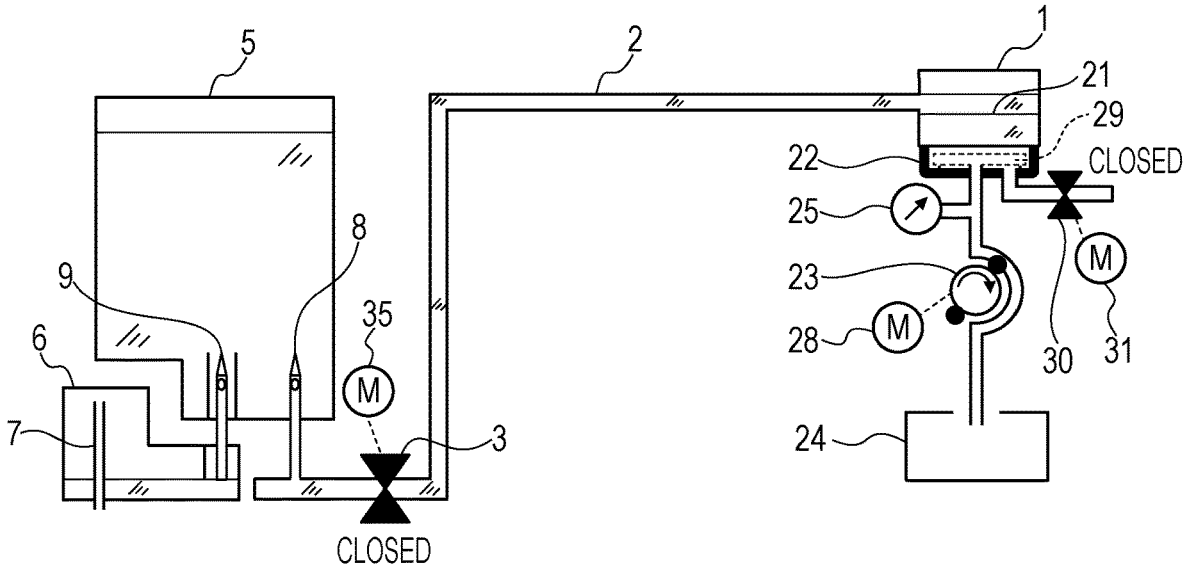
FIGS. 9A and 9B illustrate the fourth valve-closing suction operation upon initial installation of the inkjet printing apparatus according to the first embodiment.
Figure 9B:
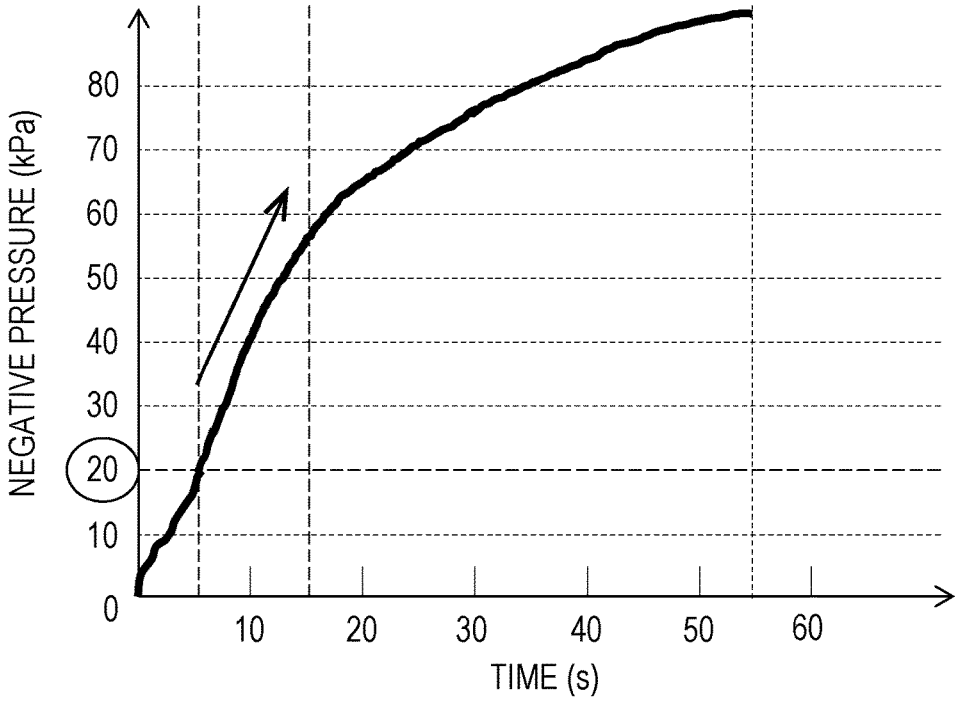

FIG. 9A illustrates a state in which the on-off valve 3 is in the closed position and the print head 1 and the supply tube 2 are depressurized in the fourth valve-closing suction operation. FIG. 9B illustrates measured pressures in this state. Referring to FIG. 9A, the print head 1 is filled with the ink.

As the valve-closing suction operation is repeated as described above, the supply tube 2 and the print head 1 are sequentially filled with the ink, and the amount of air decreases and the amount of ink increases in the ink supply path. Therefore, as illustrated in FIGS. 8B and 9B, a pressure variation per unit time increases in proportion to the number of times the valve-closing suction operation is repeated.

Figure 10:
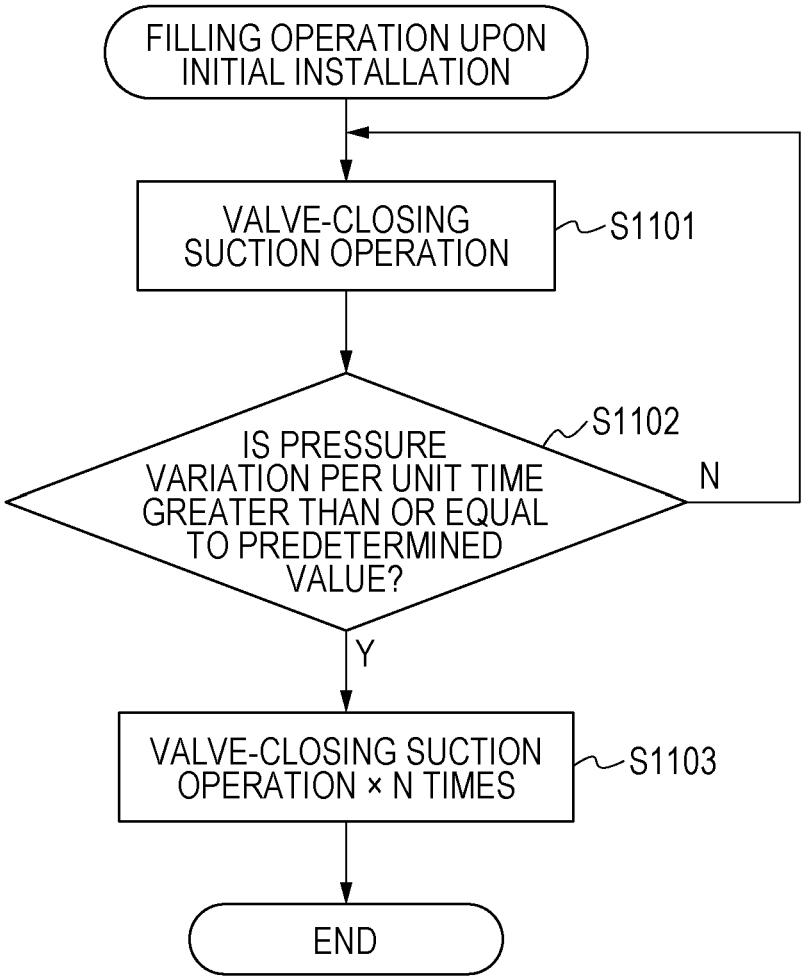
FIG. 10 is a flowchart illustrating an ink filling operation upon initial installation of the inkjet printing apparatus according to the first embodiment.

The ink filling operation or process based on a pressure variation upon initial installation will now be described with reference to a flowchart of FIG. 10. In step S1101, the valve-closing suction operation illustrated in FIG. 4 is performed in accordance with an instruction from the CPU 11. In step S1102, the CPU 11 compares a pressure variation per unit time with a previously calculated filling target value (predetermined value). If the pressure variation is less than the filling target value (predetermined value), the process returns to step S1101 and the valve-closing suction operation is again performed.

If the pressure variation is greater than or equal to the filling target value (predetermined value), the CPU 11 determines that the whole of the supply tube 2 is filled with the ink. The process proceeds to step S1103. The valve-closing suction operation is performed the number of times necessary to fill the print head 1 with the ink. After that, the ink filling operation upon initial installation is terminated. In the present embodiment, the valve-closing suction operation is performed once (N=1) in step S1103.

As described above, an ink filling state in the ink supply path is determined based on a pressure variation measured by the pressure sensor 25 and the timing of stopping the ink filling operation is adjusted, so that a proper amount of ink can be supplied to the print head 1. This can shorten the time (hereinafter, "ink filling time") required for ink filling upon initial installation and reduce waste ink, or the amount of ink discharged.

The filling target value may be set to a value based on which it can be determined that both the supply tube 2 and the print head 1 are filled with the ink. In this case, the apparatus may be configured such that when a pressure variation reaches the filling target value, the valve-closing suction operation is stopped and an additional valve-closing suction operation is not performed.

The filling target value, based on which whether the whole of the supply tube 2 is filled with the ink is determined, is calculated in the following manner. The inner volume of the supply tube 2 is approximately 40 ml, the inner volume of the print head 1 is approximately 5 ml, and the inner volume of the ink passage between the cap 22 and the suction pump 23 is approximately 5 ml. Assuming that the whole of the supply tube 2 is filled with the ink, the amount of remaining air is approximately 10 ml. When approximately 10 ml of air is sucked by using the suction pump 23 at approximately 0.5 ml/s while the on-off valve 3 is in the closed position, a pressure variation per unit time for 10 seconds from time=5 seconds to time=15 seconds is approximately 33 kPa based on the relationship of PV=constant. Similarly, a pressure variation for 10 seconds from time=15 seconds to time=25 seconds is approximately 17 kPa, and that for 10 seconds from time=25 seconds to time=35 seconds is approximately 10 kPa. The filling target value is set based on these calculation results and is used for determination about the ink filling state.

In the present embodiment, the unit time is approximately 10 seconds from time=5 seconds to time=15 seconds after the start of suction, and the filling target value is approximately 33 kPa. To increase the accuracy of detection, a filling target value for a unit time shorter than 10 seconds may be set. Furthermore, although the flow rate of the suction pump 23 in the present embodiment is obtained based on a pressure variation per unit time in the valve-closing suction operation upon initial installation and the inner volume of the passage, a design value obtained by taking a tolerance into account may be used.

As described above, since an increase in negative pressure influenced by the liquid resistance in the discharge ports and the filter 21 of the print head 1 is approximately 20 kPa, the pressure rises up to approximately 20 kPa for approximately five seconds from the start of suction in the same manner in the graphs of FIGS. 7B, 8B, and 9B. Therefore, the CPU 11 obtains a pressure variation per unit time based on measured pressures at or above a pressure influenced by the liquid resistance in the print head 1. Thus, the amount of air in the supply tube 2 can be estimated accurately.

In the ink filling operation in the present embodiment, the CPU 11 starts to calculate the amount of ink in the maintenance cartridge 24 after a pressure variation reaches the filling target value. Although the amounts of ink in the capacity memory 26 are typically added based on the number of valve-closing suction operations performed, ink filling using the pressure sensor 25 enables the addition in the capacity memory 26 to be started after the whole of the supply tube 2 is filled with the ink. Therefore, the amount of ink in the maintenance cartridge 24 can be determined more accurately than in the case where the amount of ink is added each time the valve-closing suction operation is performed. Thus, the frequency of replacing the maintenance cartridge 24 can be reduced.

Although the ink passage for one color ink has been described in the present embodiment, the same control can be performed on the ink passages for multiple color inks. Specifically, the common cap 22 may cover a plurality of discharge port arrays for respective colors arranged in the print head 1, and the pressure sensor 25 may be disposed between the cap 22 and the common suction pump 23. For example, the common cap 22 covers the discharge port array (first discharge port array) for cyan and the discharge port array (second discharge port array) for magenta, and the common pressure sensor 25 is used. If differences in suction amount between the passages occur, the sum of amounts of air in the passages can be estimated based on a pressure variation measured by the pressure sensor 25, and the ink filling state can be determined. Since the pressure sensor 25 is disposed between the common cap 22 and the common suction pump 23, the number of components can be reduced as compared with the case where the pressure sensor 25 is disposed for each of the passages.

In the present embodiment, the suction pump 23 is the tube pump whose rotation speed is substantially constant and whose average flow rate is also substantially constant. Any other suction unit, for example, a suction unit having a variable rotation speed, may be used. In this case, the amount of air in the ink supply path can be estimated by determining a flow rate based on a rotation speed of the suction unit. The valve-closing suction operation using the on-off valve 3 disposed in the supply tube 2 has been described in the present embodiment. For example, if the supply tube 2 is short, suction may be performed while the discharge port face 20 is covered by the cap 22. In this case, the ink filling state can be similarly monitored by using the pressure sensor 25. Furthermore, although the ink filling state is monitored based on pressures measured by the pressure sensor 25 in the present embodiment, the ink filling state may be detected in any other manner. A detection unit, such as an optical sensor, for directly detecting the ink in the supply tube 2 may be disposed.

Second Embodiment

According to a second embodiment, the amount of air in the supply tube 2 is estimated, a necessary negative pressure for the suction pump 23 is determined based on the amount of air, and the valve-closing suction operation is then performed. Driven time of the suction pump 23 is changed based on the estimated amount of air, and a proper amount of ink is supplied such that the whole of the supply tube 2 can be filled with the ink. The following description focuses on differences between the first and second embodiments. A redundant description of the same details as those in the first embodiment is omitted.

Figure 11A:
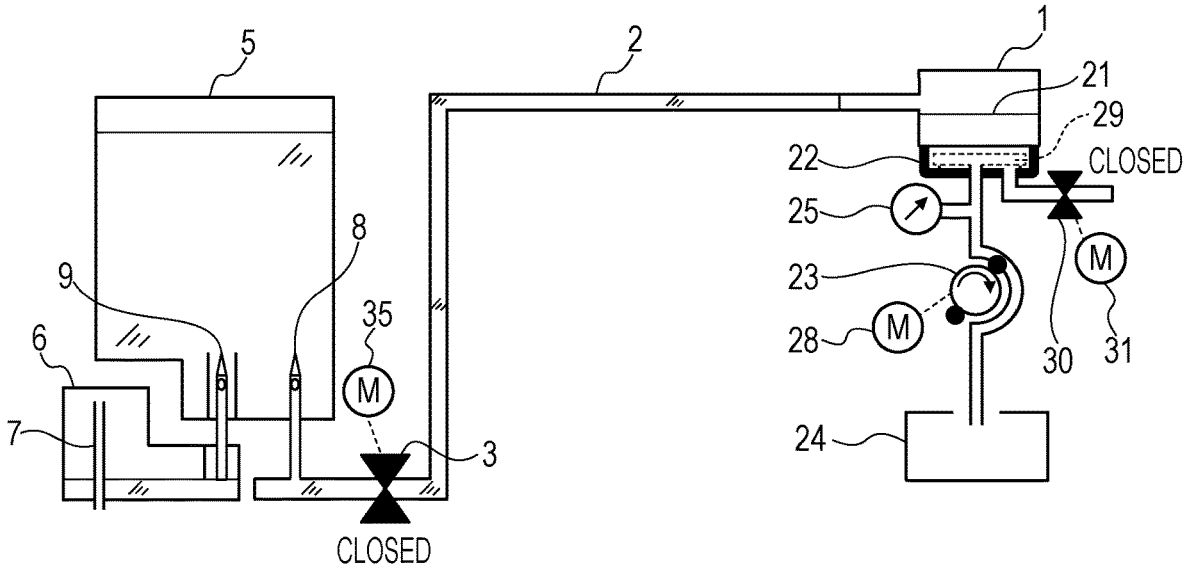
FIGS. 11A and 11B illustrate the third valve-closing suction operation upon initial installation of an inkjet printing apparatus according to a second embodiment.
Figure 11B:
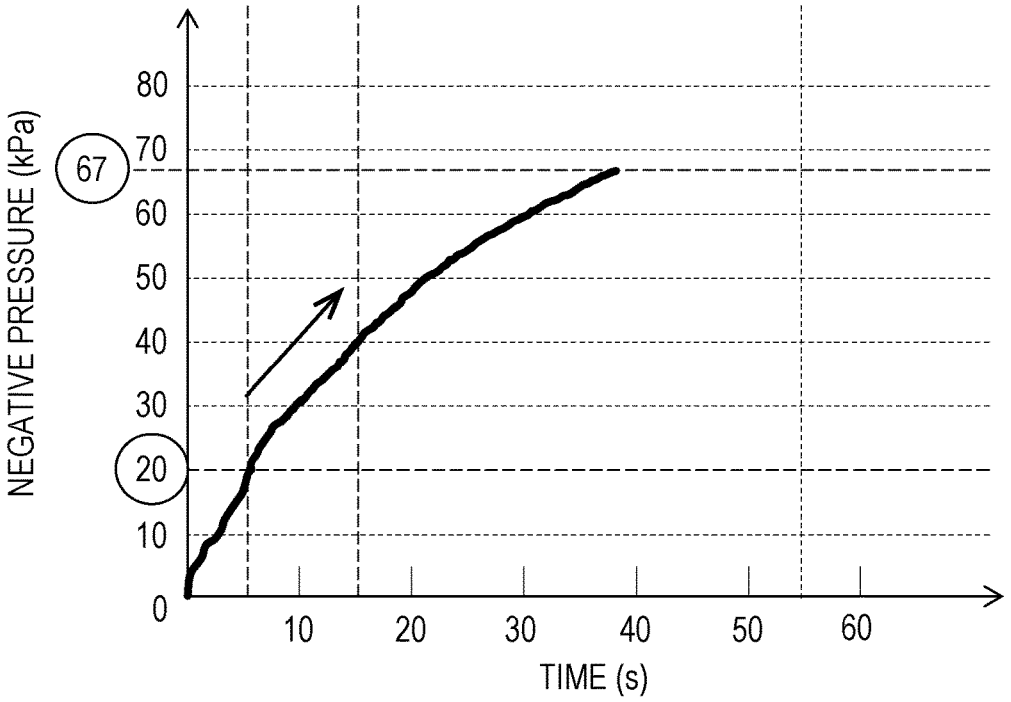

FIG. 11A illustrates a state in which the on-off valve 3 is in the closed position and the print head 1 and the supply tube 2 are depressurized in the third valve-closing suction operation upon initial installation. FIG. 11B demonstrates that a pressure variation for approximately 10 seconds from time=5 seconds to time=15 seconds after the start of suction is approximately 20 kPa. Since the rate of suction by the suction pump 23 is approximately 0.5 ml/s, the amount of air in the supply tube 2 can be estimated at approximately 9 ml.

To fill the remaining inner volume, approximately 9 ml, of the supply tube 2 with the ink, the suction pump 23 may be driven so that a negative pressure in the supply tube 2 is approximately 47 kPa. Such a negative pressure is added to a pressure of approximately 20 kPa influenced by the liquid resistance in the print head 1, so that a target negative pressure for the suction pump 23 is approximately 67 kPa.

Figure 12A:
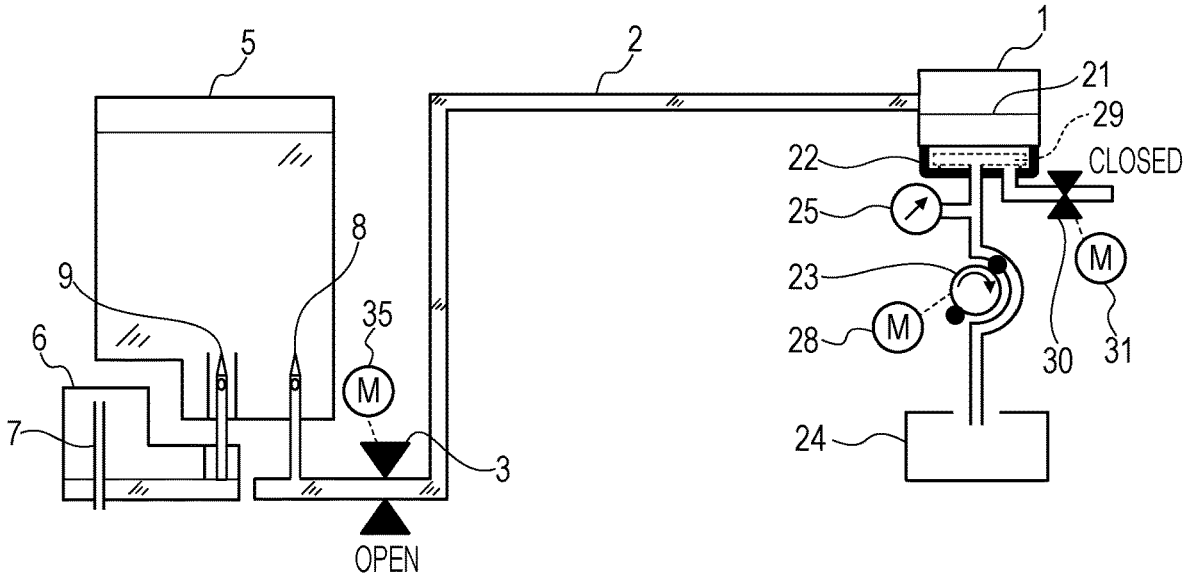
FIGS. 12A and 12B illustrate the fourth valve-closing suction operation upon initial installation of the inkjet printing apparatus according to the second embodiment.
Figure 12B:
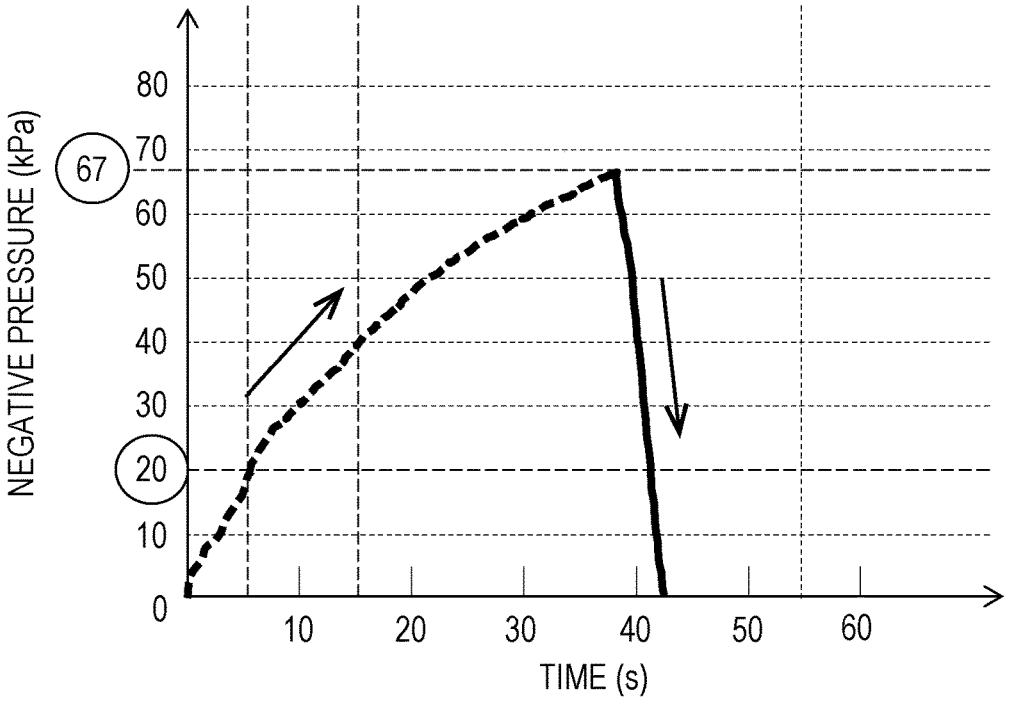

For the fourth valve-closing suction operation, the on-off valve 3 is in the closed position and the suction pump 23 is operated. After that, as illustrated in FIGS. 12A and 12B, when the pressure sensor 25 indicates approximately 67 kPa, the CPU 11 stops the suction pump 23 and switches the on-off valve 3 to the open position. Although the suction pump 23 is driven for 55 seconds in the normal valve-closing suction operation, the suction pump 23 is driven for approximately 40 seconds and is then stopped in an example illustrated in FIG. 12B. Consequently, the remaining inner volume, 9 ml, of the supply tube 2 can be filled with substantially the same amount of ink.

In the present embodiment, to fill the print head 1 with a predetermined amount of ink, the valve-closing suction operation is subsequently performed once. The ink filling operation upon initial installation is then terminated. As described above, suction through the suction pump 23 is adjusted based on a necessary negative pressure, so that the ink filling time upon initial installation can be shortened and waste ink can be reduced.

The example in which the driven time of the suction pump 23 is changed after the third valve-closing suction operation has been described in the present embodiment. Furthermore, the amount of air may be estimated after the first valve-closing suction operation. Specifically, the amount of air in the supply tube 2 may be estimated based on a pressure variation obtained in the preceding valve-closing suction operation performed once or more, and the number of valve-closing suction operations to be performed or the driven time of the suction pump 23 may be determined, so that the amount of ink to be supplied can be adjusted.

Third Embodiment

In the first and second embodiments, the pressure sensor 25 is disposed between the cap 22 and the suction pump 23 to measure a pressure variation. In a third embodiment, the pressure sensor 25 is disposed in the supply tube 2. The following description focuses on differences between the first and third embodiments. A redundant description of the same details as those in the first embodiment is omitted.

Figure 13:
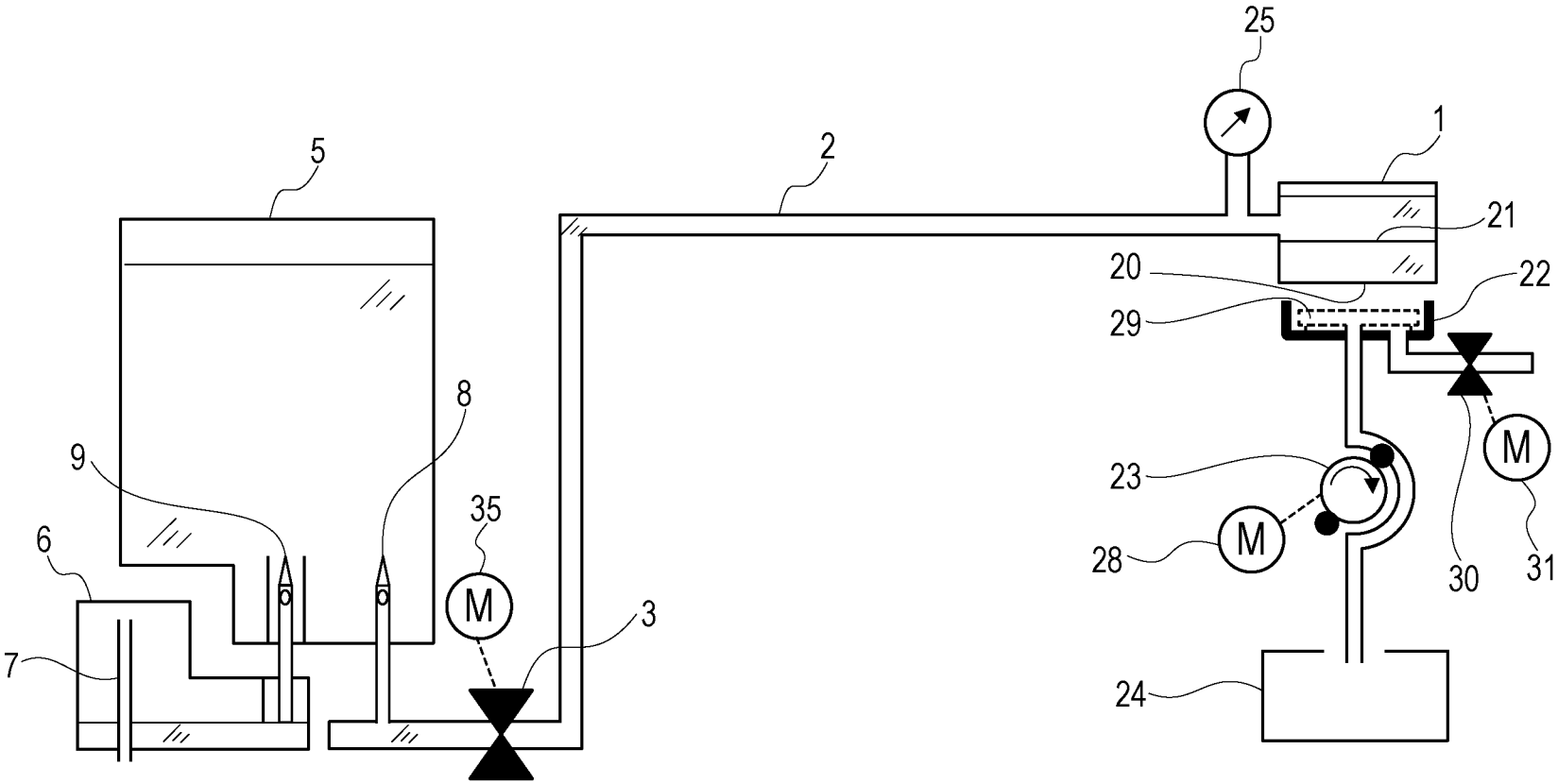
FIG. 13 is a schematic diagram illustrating an ink passage for one color ink in an inkjet printing apparatus according to a third embodiment.

FIG. 13 is a schematic diagram illustrating an ink passage for one color ink in the printing apparatus 50 according to the present embodiment. The pressure sensor 25 is disposed in the supply tube 2. The inner volume of the ink supply path and that of the ink passage between the cap 22 and the suction pump 23 are the same as those in the first embodiment.

Figure 14A:
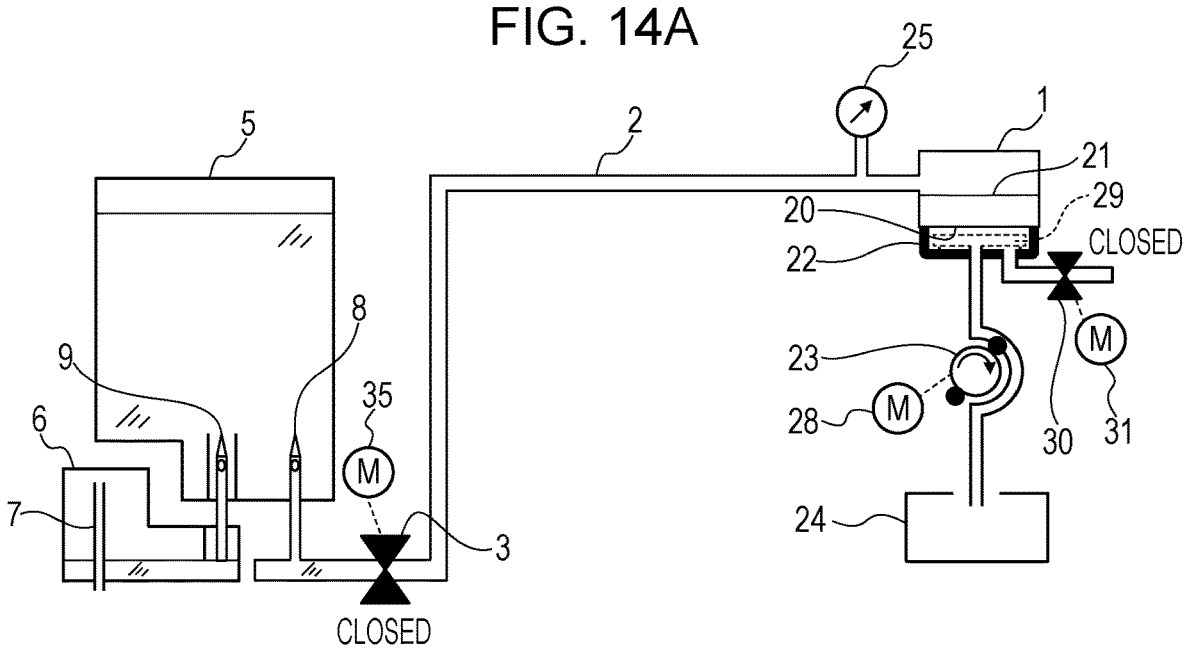
FIGS. 14A and 14B illustrate the first valve-closing suction operation upon initial installation of the inkjet printing apparatus according to the third embodiment.
Figure 14B:
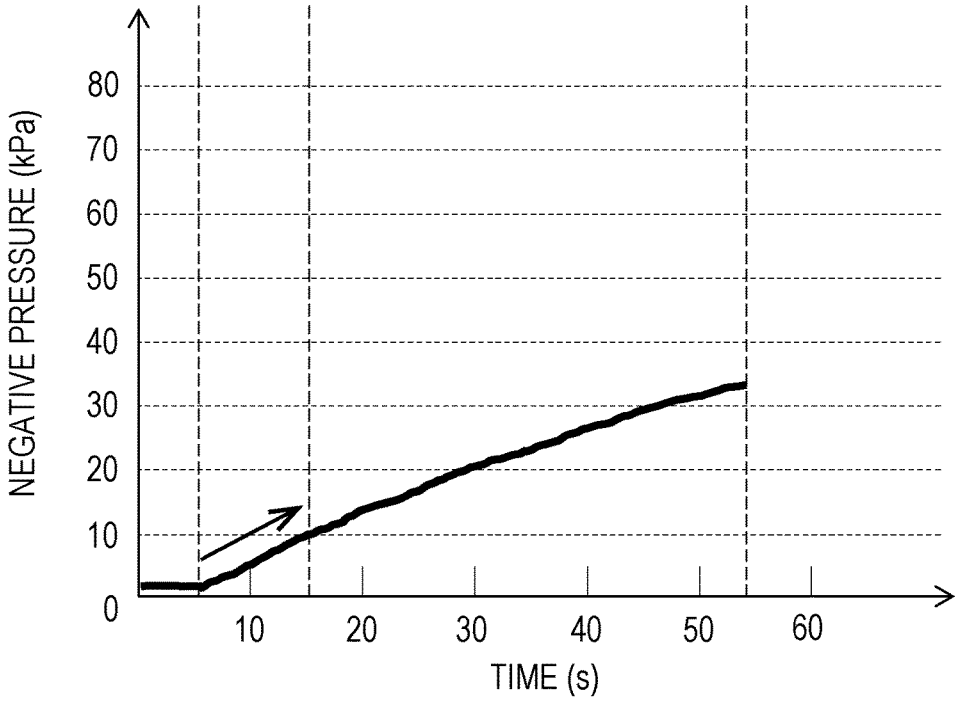
Figure 15A:
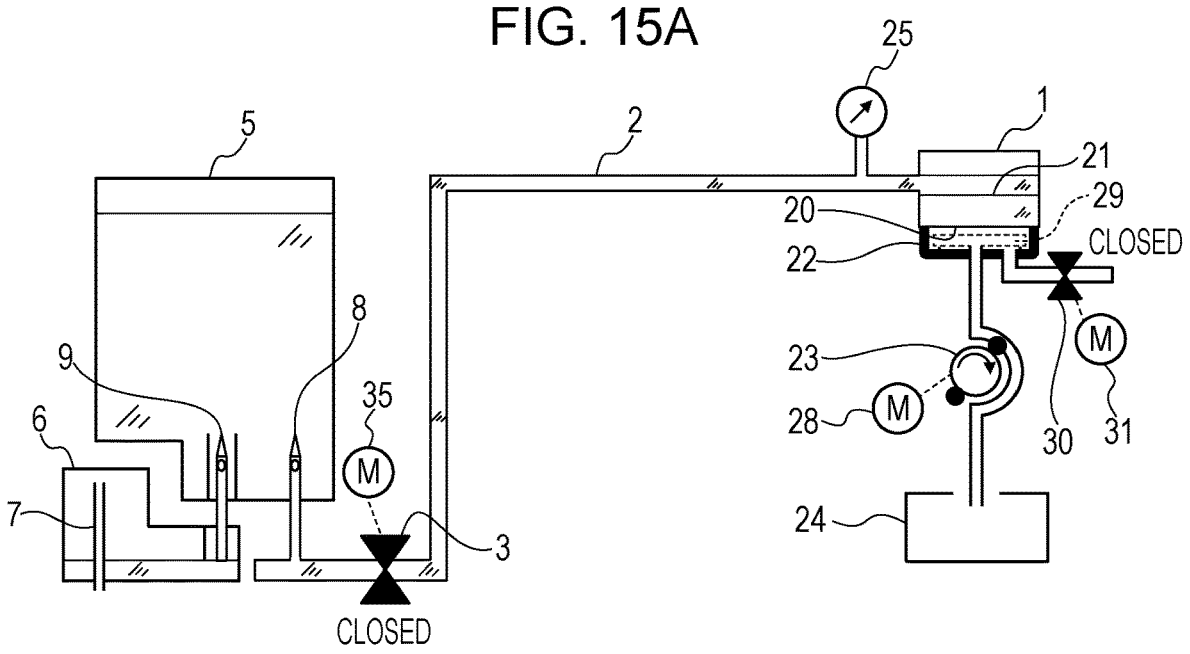
FIGS. 15A and 15B illustrate the fourth valve-closing suction operation upon initial installation of the inkjet printing apparatus according to the third embodiment.

FIG. 14A illustrates a state in which the on-off valve 3 is in the closed position and the print head 1 and the supply tube 2 are depressurized in the first valve-closing suction operation upon initial installation. FIG. 14B illustrates measured pressures in this state. FIG. 15A illustrates a state in which the on-off valve 3 is in the closed position and the print head 1 and the supply tube 2 are depressurized in the fourth valve-closing suction operation upon initial installation.

In the first embodiment, since a pressure influenced by the liquid resistance in the print head 1 is approximately 20 kPa, a pressure variation is measured based on pressures at or above approximately 20 kPa. In the present embodiment, since a pressure in the supply tube 2 is measured, an increase in negative pressure caused by the liquid resistance in the print head 1 does not occur. Under the influence of the liquid resistance in the print head 1, however, it takes time (approximately 5 seconds) before a negative pressure measured by the pressure sensor 25 begins to rise.

Figure 15B:
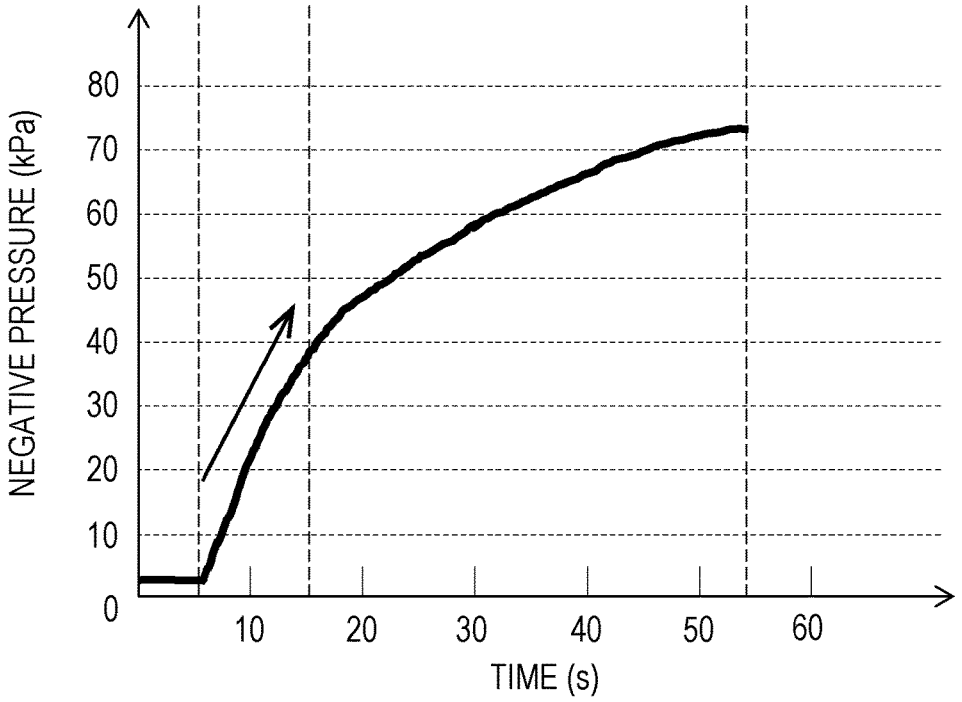

Whether the supply tube 2 is filled with the ink is determined based on a pressure variation for approximately 10 seconds from time=5 seconds to time=15 seconds after the start of suction through the suction pump 23 as in the first embodiment. FIG. 15B illustrates a pressure variation at or above a filling target value.

As described above, the pressure sensor 25 can be disposed at any predetermined position between the on-off valve 3 and the suction pump 23. As in the first embodiment, the valve-closing suction operation can be stopped based on a pressure variation, thus shortening the ink filling time upon initial installation and reducing waste ink.

The present disclosure provides the inkjet printing apparatus capable of reducing the amount of ink discharged when the print head is filled with the ink supplied from the ink tank.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-072378 filed Mar. 31, 2017, which is hereby incorporated by reference herein in its entirety.

What is claimed is:

1. An inkjet printing apparatus comprising:

a print head having a discharge port face in which a plurality of discharge ports that discharge ink are arranged;

an ink tank containing the ink to be supplied to the print head;

an on-off valve provided in an ink passage between the print head and the ink tank, the on-off valve being configured to be switchable between an open state and a closed state;

a cap configured to cover the discharge port face;

a suction unit connected to the cap, the suction unit configured to suck the ink and air in a case where the cap covers the discharge port face;

a pressure measuring unit configured to measure a pressure at a predetermined position in the ink passage between the on-off valve and the suction unit; and a control unit configured to control to perform an ink filling operation of filling the print head with the ink supplied from the ink tank, wherein the ink filling operation is an operation of sucking the ink by opening the on-off valve after driving the suction unit for a predetermined time with the on-off valve closed, and wherein the control unit controls the number of times to perform the ink filling operation based on a pressure variation per unit time measured by the pressure measuring unit in the ink filling operation.

2. The apparatus according to claim 1, wherein the control unit changes driving time of the suction unit with the on-off valve closed based on the pressure variation obtained in the ink filling operation.

3. The apparatus according to claim 1, wherein the control unit repeats the ink filling operation in a case where the pressure variation is less than a predetermined value and performs the ink filling operation for a predetermined number of times after the pressure variation exceeds the predetermined value.

4. The apparatus according to claim 1, further comprising:

a maintenance cartridge that stores the ink sucked by the suction unit; and a calculation unit configured to calculate an ink amount in the maintenance cartridge, wherein the calculation unit calculates the ink amount after the pressure variation exceeds a predetermined value.

5. The apparatus according to claim 1, wherein the pressure measuring unit is provided between the cap and the suction unit.

6. The apparatus according to claim 1, wherein the pressure measuring unit is provided between the on-off valve and the print head.

7. An ink filling method for an inkjet printing apparatus including a print head having a discharge port face in which a plurality of discharge ports that discharge ink are arranged, an ink tank containing the ink to be supplied to the print head, an on-off valve provided in an ink passage between the print head and the ink tank, a cap covering the discharge port face, a suction unit connected to the cap for sucking the ink and air in a case where the cap covers the discharge port face, and a pressure measuring unit configured to measure a pressure at a predetermined position in the ink passage between the on-off valve and the suction unit, the method comprising:

sucking the ink by opening the on-off valve after driving the suction unit for a predetermined time with the on-off valve closed;

measuring a pressure variation per unit time by the pressure measuring unit during sucking; and controlling the number of times to perform sucking based on the measured pressure variation.

* * * * *